US005109204A

United States Patent [19]

Keefer

[11] Patent Number: 5,109,204

[45] Date of Patent: Apr. 28, 1992

[54] HIGH POWER RF PRECISION ATTENUATOR

[75] Inventor: Lyndon Keefer, Phoenix, Ariz.

[73] Assignee: Honeywell Inc., Minneapolis, Minn.

[21] Appl. No.: 621,415

[22] Filed: Dec. 3, 1990

[51] Int. Cl.[5] ..... H01P 1/22
[52] U.S. Cl. ..... 333/81 A; 333/116
[58] Field of Search ..... 333/109, 116, 81 R, 333/81 A

[56] References Cited

U.S. PATENT DOCUMENTS

| | | | |
|---|---|---|---|
| 3,559,108 | 1/1971 | Seidel | 333/109 X |
| 4,216,445 | 8/1980 | Abajian | 333/81 R |
| 4,492,960 | 1/1985 | Hislop | 333/109 X |
| 4,559,489 | 12/1985 | Vacanti et al. | 333/116 X |
| 4,902,983 | 2/1990 | Fujiki et al. | 333/109 X |

FOREIGN PATENT DOCUMENTS

| | | | |
|---|---|---|---|
| 58109 | 3/1989 | Japan | 333/81 R |

OTHER PUBLICATIONS

Voltage-Controlled Attenuator with Low Phase Shift, NASA Tech Briefs, vol. 4, No. 3, Fall 1979, p. 326.

*Primary Examiner*—Paul Gensler
*Attorney, Agent, or Firm*—Seymour Levine; Dale E. Jepsen; Donald J. Lenkszus

[57] ABSTRACT

A precision variable attenuator includes quadrature hybrid circuits, each having a first pair of isolated ports corresponding to the input and output ports of the attenuator. The second pair of isolated ports each are terminated with variable impedances in a manner to provide equal reflection coefficients at each port. Signals incident to the input port are coupled to the second pair of isolated ports and reflected therefrom to be coupled to the output port.

9 Claims, 2 Drawing Sheets

HIGH POWER RF PRECISION ATTENUATOR

FIELD OF THE INVENTION

1. Field of the Invention

The invention pertains to the field of RF attenuators and, more particularly, to RF variable attenuators that provide selected attenuations with relatively tight attenuation tolerances.

2. Description of the Prior Art

Microwave attenuators of the prior art include the Pi and T circuit configurations which may utilize either (PIN) diodes or field effect transistors (FETs) for the series and shunt resistors of the circuits. PIN diodes and FETs exhibit resistive changes with properly applied DC voltages and thus are useful as variable resistors. The resistive values of these Pi and T circuits for all levels of attenuations are chosen to provide an impedance that matches the impedance of the transmission lines, or another microwave device, to suppress reflections in the system. To accomplish this, the ratio of shunt and series resistors must change with attenuation changes, establishing a functional relationship of the ratio versus attenuation which is extremely non-linear. This presents a very difficult tracking problem, requiring that the dc characteristics of the PIN diodes or FETS utilized in the attenuators be matched over the entire attenuation range. As a result, the PIN diodes and FETs are generally controlled with separate power supplies. Though control circuitry can be provided to supply the DC voltages to the voltage controlled resistances in their proper functional relationship from a single power supply, such circuitry requires much more real estate than the attenuator it controls and is therefore rejected for most applications.

The problem of providing the proper ratios to maintain a constant characteristic impedance for the Pi and T circuits is exacerbated by the non-uniformity of the PIN diode and the FET characteristics that result with present day manufacturing processes. For example, the equivalent resistance value of the FET is a function of the pinch-off voltage, that voltage which must be exceeded by the gate voltage for current to flow in the FET. Present day manufacturing processes, however, yield FETs with pinch-off voltages that vary substantially. Since the resistance of the FET is a function of the pinch-off voltage, FETs exhibit resistance values having varying functional relationships of the gate voltage. Thus, for each attenuator a process is encountered for selecting three FETs, for each stage, with equal resistance versus gate voltage characteristics, greatly increasing the cost of the attenuators.

Further, the resistive Pi and T circuits cannot simultaneously realize low off state insertion loss and a large dynamic attenuation range with the variable resistors presently available. For both circuits a low insertion loss requires a low resistance value for the series elements and a high resistance value for the shunt elements. As attenuation increases from the minimum value the series resistance increases, while the shunt resistance decreases. Since the shunt resistance and series resistance start at opposite ends of the functionality curve it is extremely difficult to provide the ratio of series resistance to shunt resistance required for many attenuation values desired and simultaneously maintain a constant characteristic impedance for the circuits.

Additionally, at high frequencies, the internal capacitances of the PIN diodes and FETs establish complex characteristics for the Pi and T circuits. To provide real characteristic impedances it is necessary to resonant these capacitances by shunting inductors across the elements of the Pi and T circuits. These resonant circuits severely limit the operating bandwidth of the attenuator.

An attenuator which provides improved performance over

T circuits d in U.S. Pat. No. 4,970,478 issued to Scott A. Townley and assigned to the assignee of the present invention. This patent discloses a variable microwave attenuator which includes a plurality of ladder circuits (cells), each having a series inductance and shunt circuit comprising a capacitor and a variable resistor in parallel. The cells are cascaded in a manner to establish an artificial transmission line with distributed loss, represented by the variable resistor shunt elements. The variable resistor shunt elements may be realized by utilizing of FETs which exhibit resistive changes with changes of voltage applied to their gates. The series inductance, shunt capacitance, and shunt variable resistors are chosen to establish an impedance for the artificial line that is substantially independent of the shunt resistance value and to provide a low reflection coefficient with its concomitant low voltage standing wave ratio (VSWR). When cascaded, the internal ladder sections combine to form lossless symmetrical Pi cells with a variable resistor positioned between each cell. Symmetry of the artificial line may be completed with the addition of a shunt capacitor at one end of the artificial line to establish lossless symmetrical Pi end sections at the ends of the transmission line that are identical to the internal lossless symmetrical Pi sections formed by the cascading of the ladder networks.

Though the artificial line of U.S. Pat. No. 4,970,478 provides variable attenuation by the adjustment of but one resistance value per cell and may provide a characteristic impedance which is independent of the shunt resistance value, such performance is difficult to achieve. Further due to the resistance variation of PIN diodes and FETs previously discussed, a variable attenuator that provides attenuations with reasonable precision requires extensive calibration, adding appreciably to the cost of the devise.

Another variable microwave attenuator of the prior art provides variable attenuation by switchably coupling resistors of equal value across the two output ports of a quadrature hybrid circuit, the output ports, with the resistors coupled there across, are then coupled to the input ports of a second quadrature hybrid. One input port of the first hybrid and one output port of the second hybrid are terminated with the characteristic impedance of the hybrids to absorb power coupled to these ports. The remaining input port of the first hybrid and the remaining output port of the second hybrid, respectively, serve as the input and output ports of the attenuator.

The coupling between the hybrids form shunt loaded transmission lines, with attenuations that are functions of the shunt loading. Energy coupled through these transmission lines are added at the output port of the attenuator to provide the output signal.

These devices are costly of components and do not provide precise attenuation settings. Switching is generally accomplished with the utilization of diode switches which exhibit impedance variations between diodes and with age, thus requiring extensive initial calibration and periodic calibrations to achieve any degree of precision. Consequently, such devices are unacceptable for use with equipment requiring a high degree of reliability over extended periods of time.

SUMMARY OF THE INVENTION

In accordance with the principles of the present invention a precision microwave variable attenuator is provided by utilizing a first pair of isolated quadrature hybrid ports as the input and output ports of the attenuator and providing the second pair of isolated ports with switchably coupled resistive terminations, the resistance at each terminated port being equal and selected in accordance with the attenuation desired. Since these resistors are not matched to the hybrids characteristic impedance the portions of the signals incident to the terminated ports from the input port that are not absorbed in terminating resistors are reflected in a manner to be out-of-phase at the input port, thus cancelling thereat, and to be in phase at the output port, thus adding thereat to provide the attenuated output signal. Arrays of commonly manufactured surface mount resistors are substituted for the typically expensive custom designed high power microwave terminations, thereby allowing for inexpensive and convenient accommodation of the variances in, impedance, breakdown voltage, power consumption and manufacturers tolerances that may occur in microstrip circuit boards. Novel tuning techniques are employed to eliminate attenuation variations due to variances of switching diode impedances, which are functions of applied power, and variations in the resistive circuit characteristics due to temperature variations.

The aspects and advantages of the invention will be understood more fully from the following description of the preferred embodiment thereof, which is by way of example only, with reference to the accompanying drawings.

DESCRIPTION OF THE PREFERRED EMBODIMENTS

Figure 1:
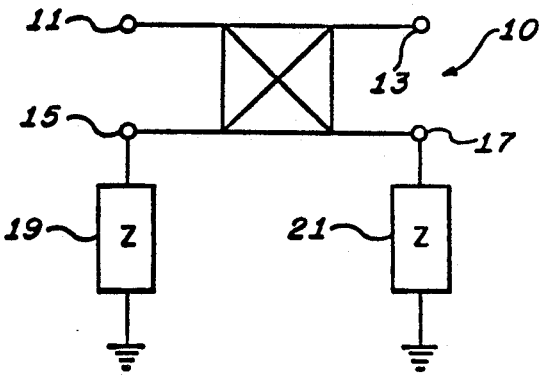
FIG. 1 is a schematic diagram of a preferred embodiment of the invention.

Shown in FIG. 1 is a quadrature hybrid circuit 10, exhibiting a characteristic impedance, having an input port 11, an output port 13, and ports 15 and 17, respectively, terminated by equal impedances 19 and 21, which provide equal reflection coefficients Γ with respect to the characteristic impedance of the hybrid circuit 10. Those skilled in the art will recognize that Γ is given by:

$$\Gamma = \frac{Z - Z_o}{Z + Z_o} \tag{1}$$

and that the reflected voltage $V_R$ $$V_R = \Gamma\, V_I \tag{2}$$

where $V_I$ is the voltage incident to the termination. Hybrid circuit 10 characteristics are such that a signal incident to input port 11 couples equally between terminated ports 15 and 17. The signal at the terminated port (15), however, is in phase with the signal incident to input port 11, while the signal at the terminated port 17, is phase shifted by 90° (in quadrature) with respect to the signal incident to input port 11. No energy is directly coupled between input port 11 and output port 13. Further, signals incident to ports 15 and 17 (i.e. reflected from terminations 19 and 21 respectively) couple with equal signal levels to ports 11 and 13. The coupling between ports 11 and 15 is without a phase shift and between ports 15 and 13 with a 90° phase shift, while the coupling between ports 17 and 11 is with a 90° phase shift and between 17 and 13 is without a phase shift. Since the terminating impedances 19 and 21 are equal, it should be recognized that reflections from these terminations cancel at input port 11 and add at output port 13. The above may be expressed mathematically by the matrix equations (3)-(5).

Those skilled in the art will recognize that the scattering matrix equation for a hybrid circuit having a signal $I_{11}$ input to port 11 and equal reflecting terminations at ports 15 and 17 is given by:

$$\begin{bmatrix} R_{11} \\ R_{13} \\ R_{15} \\ R_{17} \end{bmatrix} = \sqrt{2} \begin{bmatrix} 0 & 0 & 1 & j \\ 0 & 0 & j & 1 \\ 1 & j & 0 & 0 \\ j & 1 & 0 & 0 \end{bmatrix} \begin{bmatrix} I_{11} \\ 0 \\ \Gamma R_{15} \\ \Gamma R_{17} \end{bmatrix} \tag{3}$$

where $R_{11}$–$R_{17}$ are the signals reflected form the hybrid ports 11–17 and $I_{11}$, $\Gamma R_{15}$, $\Gamma R_{17}$ are the signals incident to ports 11, 15, and 17, respectively. The column matrix on the right may be given by the following matrix equation:

$$\begin{bmatrix} I_{11} \\ 0 \\ \Gamma R_{15} \\ \Gamma R_{17} \end{bmatrix} = \begin{bmatrix} 1 & 0 & 0 & 0 \\ 1 & -1 & 0 & 0 \\ 0 & 0 & \Gamma/\sqrt{2} & 0 \\ 0 & 0 & 0 & j\Gamma/\sqrt{2} \end{bmatrix} \begin{bmatrix} I_{11} \\ I_{11} \\ I_{11} \\ I_{11} \end{bmatrix} \tag{4}$$

substituting equation (4) into equation (3) provides an equation which gives the signals $R_{jk}$ reflected from the hybrid in terms of the input signal $I_{11}$ $$\begin{bmatrix} R_{11} \\ R_{13} \\ R_{15} \\ R_{17} \end{bmatrix} = \begin{bmatrix} 0 & 0 & \Gamma/2 & -\Gamma/2 \\ 0 & 0 & j\Gamma/2 & j\Gamma/2 \\ \frac{1+j}{\sqrt{2}} & \frac{-j}{\sqrt{2}} & 0 & 0 \\ \frac{1+j}{\sqrt{2}} & \frac{-1}{\sqrt{2}} & 0 & 0 \end{bmatrix} \begin{bmatrix} I_{11} \\ I_{11} \\ I_{11} \\ I_{11} \end{bmatrix} \tag{5}$$

It is evident from equation (5) that the signal $R_{13}$ at the output terminal 13 is $$R_{13} = j\Gamma I_{11} \quad (6)$$

and the attenuation L of the circuit is $$L = 20\log|R_{13}/I_{11}| = 20\log|\Gamma| \quad (7)$$

Should a multiplicity N of circuits shown in FIG. 1 be cascaded, each having terminations (19, 21) at the output ports (15, 17) which differ for each stage of the cascade the total attenuation provided will be $$L_N = \sum_{n=1}^{N} 20\log|\Gamma_n| \quad (8)$$

Figure 2:
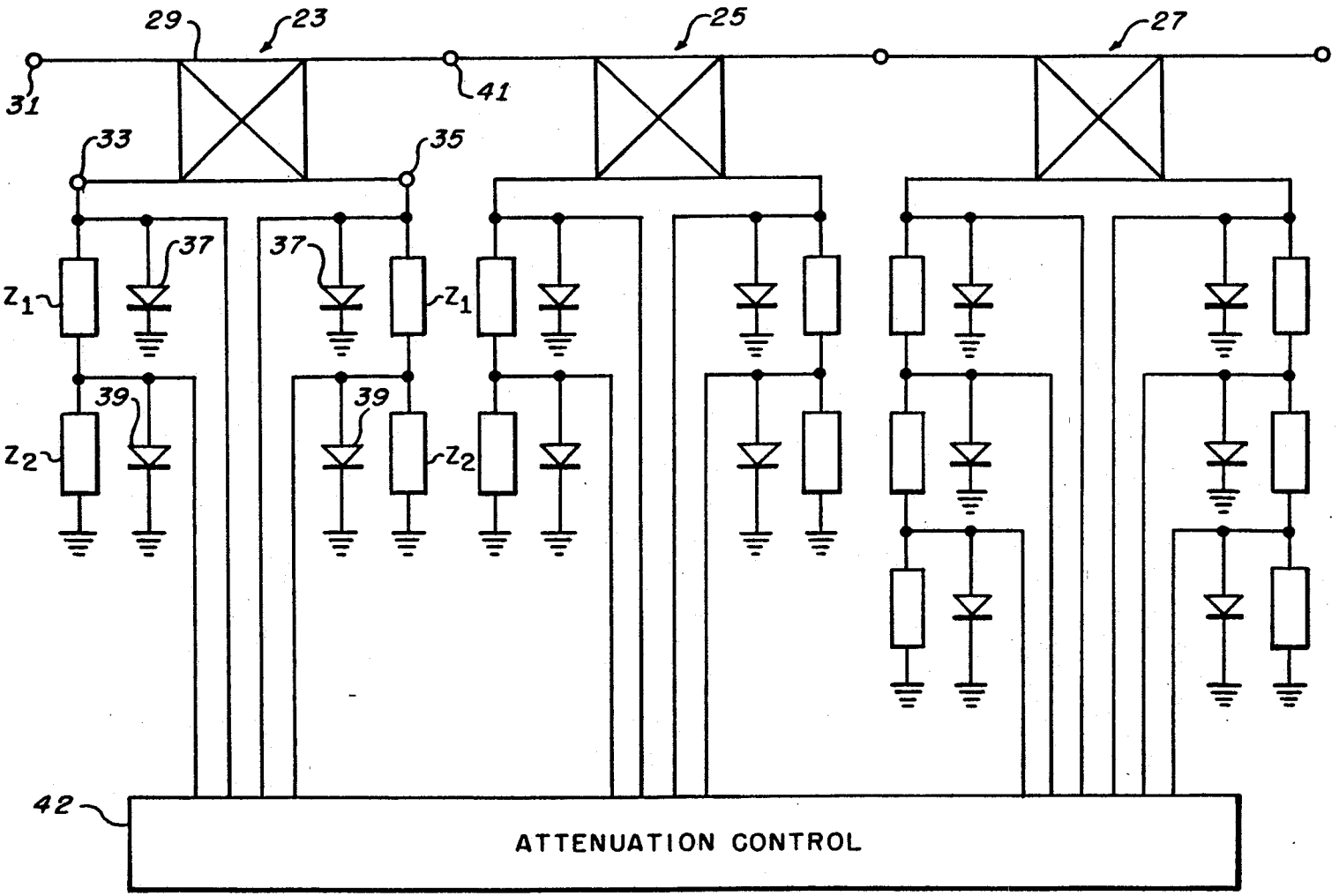
FIG. 2 is a schematic diagram of another preferred embodiment of the invention utilizing a cascade of three states, each in accordance with the embodiment of FIG. 1.

Refer now to FIG. 2 wherein a schematic diagram of a cascade containing three stages is shown. Though only three stages are shown it should be recognized that any number of stages may be cascaded. Each stage has switchable terminations to provide a variable attenuator. The input stage 23 and the central stage 25 are configured to provide two levels of attenuation while the output stage (27) is configured to provide three levels of attenuation. Since all three stages operate in the same manner to provide a per stage variable attenuation, explanation of the manner in which the variable attenuation is achieved, will be provided with reference to the circuitry of the input stage (23).

As previously stated signals coupled to the input port 31 split equally between the terminated ports 33 and 35 with the signal coupled to the terminated port 35 experiencing a 90 degree phase shift. The terminations at the ports 33 and 35 are controlled by diode pairs 37 and 39 upon command from an attenuation control 42. The impedance terminating the ports 33 and 35 is $Z_i + Z_2$ when the diode pairs 37 and 39 are both in the non-conducting state, $Z_i$ when the diode pair 39 is in the conducting state (effectively shorting $Z_2$ and grounding $Z_1$) and the diode pair 37 is in the open state, and zero when the diode pair 37 is in the conducting state (effectively shorting the ports 33 and 35) the reflection coefficients for these three states are:

$$\Gamma_a = \frac{(Z_1 + Z_2) - Z_0}{(Z_1 + Z_2) + Z_0} \quad 9(a)$$

$$\Gamma_b = \frac{Z_1 - Z_0}{Z_1 + Z_0} \quad 9(b)$$

$$\Gamma_c = \frac{0 - Z_0}{0 + Z_0} = -1 \quad 9(c)$$

Since the reflection coefficient of (−1) established by shorting the ports 33 and 35 causes the signals incident to the terminations at the ports 33 and 35 to be entirely reflected back to the hybrid 29, the signal at the output port 41 differs from that incident to the input port 31 only by a phase shift equal to 270 degrees, which is due to the 180 degrees phase shift at the ports 33 and 35 and the 90 degree phase shift provided by the hybrid circuit 29. This is easily verified by substituting (−1) for Γ in equation (2). Thus, when short circuits appear at terminated ports of a stage no signal attenuation is realized for that stage.

Figure 3:
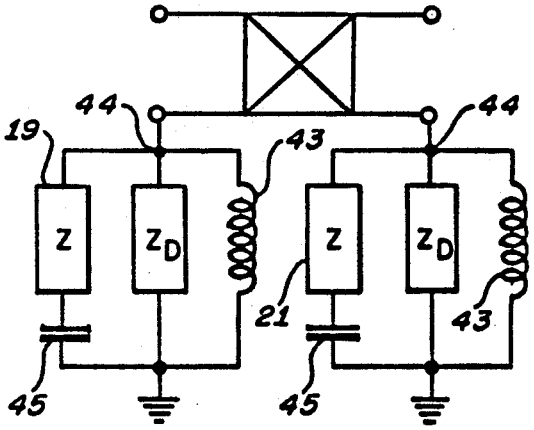
FIG. 3 is a schematic diagram of the embodiment of FIG. 1 indicating therein tuning employed to provide precision and stability.

Refer now to FIG. 3 with continued reference to FIG. 2. In FIG. 3 an inductance 43 is shown in parallel with $Z_D$, which represents the diode impedance, and a capacitor 45 is shown in series with the terminating impedances 19 and 21. Though the diodes are RF matched at all stages, as will be explained, the inductance 43 may be required for the middle stage 25 and output stage 27 to compensate for variations in the parasitic reactance of the diodes with variations in applied RF power levels. In general, this compensation is not required for the input stage 23, since the RF power across the diodes for this stage does not vary significantly. Without the matching inductance 43, significant impedance variations, due to signal level variations, are established at the terminated ports of the hybrids, which cause variations in the attenuation characteristics.

Line lengths of hybrid circuits may vary with temperature, especially when the circuits are constructed in microstrip or stripline. These line length temperature variations adversely affect the coupling characteristic of the hybrid circuit and concomitantly the attenuation calibration of the attenuator. Positioning a capacitor of properly selected value reduces the effect of the hybrid line length variation with temperature and provides an attenuation calibration that is constant over a wide range of temperatures.

Figure 4:
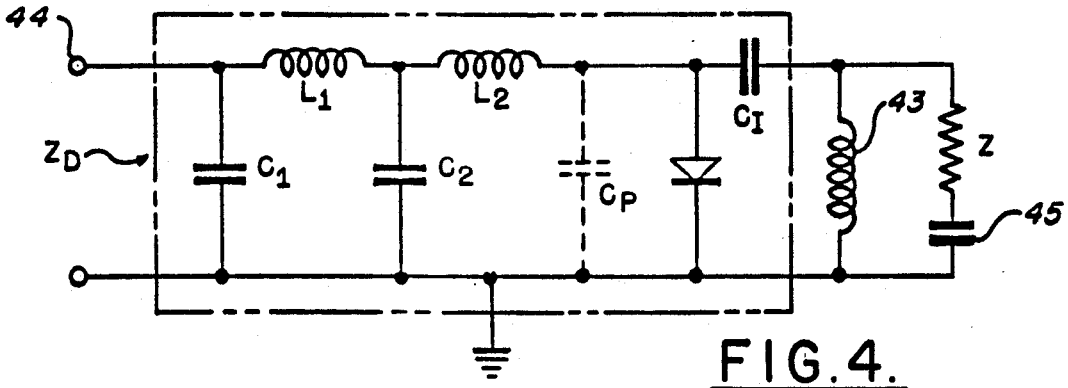
FIG. 4 is a schematic diagram of the switching circuit ZD shown in FIG. 3.
Figure 4A:
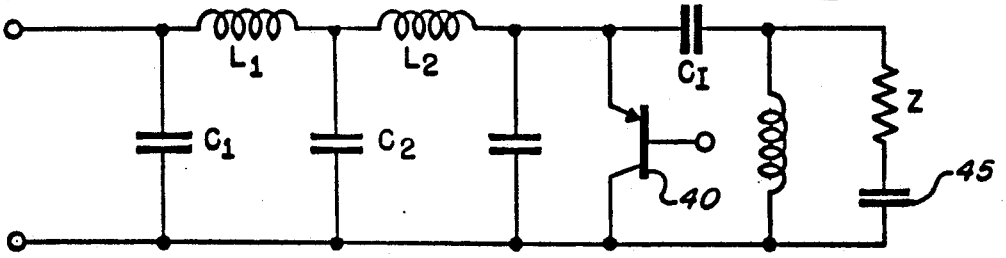
FIG. 4A is a schematic diagram of a switching circuit utilizing transistor switches.

A schematic diagram of the diode RF matching and control voltage isolation circuit is shown in FIG. 4. This circuit may be a conventional low pass filter comprising series inductors $L_1$, $L_2$, shunt capacitors $C_1$, $C_2$, parasitic $C_p$ capacitance of the diode, and a control voltage isolation capacitor $C_I$. Since capacitor $C_I$ exhibits a constant capacitance its effect on the filter performance may be included in the filter design. The parasitic capacitance, however, is not constant, varying with the voltage applied to the diode. These variations adversely affect the filter performance and compensation is required. Those skilled in the art should readily verify that a properly chosen value for the inductance 43 positioned in parallel with the series combination of the isolation capacitor $C_I$ and the parasitic capacitance $C_P$, effectively reduces the effect of variations in $C_P$, on the filter impedance as seen between terminal 44 and ground. Though the reflection coefficient switching has been described with the utilization of diode switches, it should be recognized that other types of switching may be utilized, e.g. transistor switches 40 shown in FIG. 4A.

Figure 5:
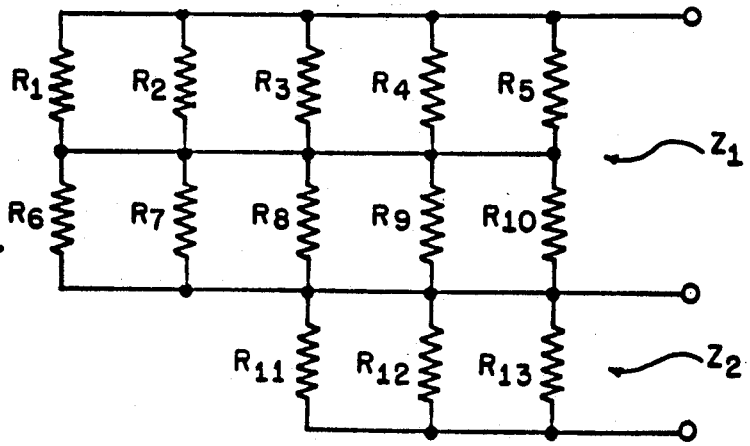
FIG. 5 is a schematic diagram of a high power resistive array that may be employed for the impedances Z1 and Z2 of FIG. 2.

Refer now to FIG. 5 wherein resistor arrays that may be employed for the impedances $Z_1$ and $Z_2$ are shown. The resistors $R_1$–$R_{13}$ may be surface mount resistors which are commercially available. Such resistors have a consistent microstrip circuit board mounting configuration, provide repeatable RF characteristics, and have a small size which allows a reasonable "lumped constant" approximation at RF frequencies. The impedance $Z_1$ may be configured as a parallel combination of resistors $R_1$–$R_5$ in series with the parallel combination of resistors $R_6$–$R_{10}$, while the impedance $Z_2$ may be only the parallel combination of $R_{11}$–$R_{13}$. The arrays shown are merely illustrative. It should be apparent that other combinations of series and parallel resistors may be utilized.

Resistor arrays, such as that shown in FIG. 5, are inexpensive, may use widely available components, and have the following desirable characteristics:

The total number of resistors in a array can be easily adjusted in accordance with power consumption requirements;

The number of rows in an array can easily be selected to provide an array having high RF voltage breakdown.

Once the number of resistors has been determined in accordance with the above the value of the resistors may be chosen to satisfy equation (1).

A small number of elements of the array can be incremented with standard resistor values to obtain a very fine adjustment of the total array impedance to compensate for variations in the characteristic impedance of a microstrip substrate.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. An attenuator including a hybrid circuit of the type providing first and second pairs of isolated ports constructed such that a signal incident to one port of the first pair of isolated ports couples signals to said second pair of isolated ports that are of equal amplitude with a 90 degree phase relation therebetween and a signal incident to one port of the second pair of isolated ports couples signals to the first pair of isolated ports that are of equal amplitude with a 90 degree phase relation therebetween comprising:

means for coupling an input signal to said one port of said first pair of isolated ports; and reflection means coupled to said second pair of isolated ports for providing equal reflection coefficients at each port of said second said second pair of isolated ports, said reflection means including a plurality of impedances serially coupled to each port of said second pair of isolated ports; and switching means coupled to said plurality of impedances to provide selectable reflection coefficients at said pair of isolated ports, said switching means having means switchable between non-conducting and conducting states, said switchable means being coupled between ground and junction points of said serially coupled impedances, and between ground and said second pair of isolated ports.

2. The attenuator of claim 1 wherein said switchable means includes diodes.

3. The attenuator of claim 2 further including inductances coupled in parallel with said said diodes.

4. The attenuator of claim 1 wherein said switchable means includes transistor switches.

5. The attenuator of claim 1 further including a capacitor coupled between said plurality of serially coupled impedances and ground.

6. The attenuator of claim 1 wherein said attenuator is constructed of microstrip components mounted on a microstrip circuit board.

7. The attenuator of claim 6 wherein said plurality of impedances comprise arrays of surface mount resistors.

8. The attenuator of claim 7 wherein said surface mount resistors are arranged in parallel and series combinations.

9. The attenuator of claim 1 wherein said plurality of impedances comprise resistor arrays constructed to provide series and parallel resistor combinations.

* * * * *